US006176631B1

(12) United States Patent
Gueret

(10) Patent No.: US 6,176,631 B1
(45) Date of Patent: Jan. 23, 2001

(54) BRUSH FOR A MAKE-UP PRODUCT COMPRISING A TUFT OF SUBSTANTIALLY PARALLEL BRISTLES MADE FROM AN ELASTOMERIC THERMOPLASTIC OR VULCANIZED MATERIAL

(75) Inventor: Jean-Louis Gueret, Paris (FR)

(73) Assignee: L'Oreal, Paris (FR)

( * ) Notice: Under 35 U.S.C. 154(b), the term of this patent shall be extended for 0 days.

(21) Appl. No.: 08/403,288

(22) Filed: Mar. 13, 1995

(30) Foreign Application Priority Data

Mar. 14, 1994 (FR) ..... 94 02945

(51) Int. Cl.[7] ..... A46B 11/00
(52) U.S. Cl. ..... 401/129; 401/126; 15/207.2
(58) Field of Search ..... 401/126, 129, 401/130, 128; 15/167.3, 207.2, 129

(56) References Cited

U.S. PATENT DOCUMENTS

| | | | | |
|---|---|---|---|---|
| 2,348,515 | * | 5/1944 | Baumgartner | 401/128 X |
| 2,721,561 | * | 10/1955 | Dyche | 401/129 |
| 4,263,691 | * | 4/1981 | Pakarnseree | 15/207.2 |
| 4,305,234 | | 12/1981 | Pichelman et al. . | |
| 4,480,351 | * | 11/1984 | Koffler | 15/187 |
| 4,635,659 | * | 1/1987 | Spatz | 401/129 X |
| 4,795,218 | * | 1/1989 | Seidler | 300/21 |
| 4,927,281 | * | 5/1990 | Gueret | 401/129 |
| 5,020,551 | * | 6/1991 | Guerret | 401/129 X |
| 5,159,736 | * | 11/1992 | Newell | 401/129 X |
| 5,238,011 | * | 8/1993 | Gueret | 132/218 |
| 5,443,906 | * | 8/1995 | Pihl et al. | 428/370 |

FOREIGN PATENT DOCUMENTS

| | | | | |
|---|---|---|---|---|
| 0 239 270 | | 9/1987 | (EP) . | |
| 0 329 505 | | 8/1989 | (EP) . | |
| 0 405 819 | | 1/1991 | (EP) . | |
| 0 509 852 | | 10/1992 | (EP) . | |
| 2 687 055 | | 8/1993 | (FR) . | |
| 2159699 | * | 12/1985 | (GB) | 401/129 |
| 2016098 | * | 1/1990 | (JP) | 401/129 |
| 93 14251 | | 7/1993 | (WO) . | |

* cited by examiner

*Primary Examiner*—David J. Walczak
(74) *Attorney, Agent, or Firm*—Oblon, Spivak, McClelland, Maier & Neustadt, P.C.

(57) ABSTRACT

The invention relates to a brush for the application of a make-up product comprising a tuft (2) of substantially parallel bristles (3), a first end (8) of these bristles (3) being fixed to a free end (5*a*) of a stem (5), characterized in that all, or a proportion of the bristles (3) of the tuft (2) are made of at least one elastomeric, thermoplastic or vulcanized material.

25 Claims, 4 Drawing Sheets

BRUSH FOR A MAKE-UP PRODUCT COMPRISING A TUFT OF SUBSTANTIALLY PARALLEL BRISTLES MADE FROM AN ELASTOMERIC THERMOPLASTIC OR VULCANIZED MATERIAL

BACKGROUND OF THE INVENTION

1. Field of the Invention

The present invention relates to a brush for the application of a make-up product such as a nail varnish, a liquid make-up for the lips, or a liquid make-up foundation, of the kind which comprise bristles disposed substantially parallel to each other in a tuft and fixed on a support herein called a brush stem. It also relates to a unit for the application of a nail varnish.

2. Discussion of the Background

The conventional brushes for applying nail varnish generally have a tuft of approximately 600 bristles with a diameter of 0.08 mm which are made most frequently of polyamide, for instance of nylon 6, 6-6, 6-10, 6-12, of nylon 11 or of polyester.

The make-up brushes currently developed leave much to be desired as regards to the precision and speed of making-up, in particular during the application of a varnish to the nails.

Moreover, with a conventional make-up brush, it is often necessary to dip the brush several times into the container containing the product in order to effect the making up of the nails, one after the other, since the quantity of the product taken up by the brush is relatively small.

Various technological solutions have been proposed to cope with this drawback, for example by incorporating a kind of reservoir in the brush stem. However, these technological solutions to the problem complicate the manufacture and the use of the brush. Furthermore, these solutions to the problem are relatively expensive. Moreover, it has been found that by increasing the diameter of the polyamide brush bristles, and reciprocally by reducing their number, see in particular FR-A 2 687 055, one could increase the interstices between the bristles and, as a result, obtain a greater product charge and greater inherent capacity for the brush. However, it has been found that during the application of a nail varnish this brush spreads insufficiently on the surface to be treated, and that it forms striae in the layer of varnish deposited on the nail, which is in no way desirable from an aesthetic point of view. In this case, it has been found that the brush pushes the product over the surface.

The aim of the present invention is to provide a make-up brush which makes it possible to remedy these disadvantages. In particular, this brush should ensure a precise application of make-up while carrying far more of the product than a conventional brush, and have a greater inherent capacity than the conventional brushes making it possible to deposit a more substantial layer thickness, resulting in greater ease of application as far as the user is concerned.

After numerous tests, it has been found that by the judicious adjustment of certain characteristics of a make-up brush, one could surprisingly obtain a more homogeneous application of a layer of the make-up product, in particular when the brush is intended for the application of nail varnish. Moreover, the layer of varnish obtained after drying has a better mechanical strength than that according to the prior art and has a better adhesion on the nail.

It has been observed that by adjusting the hardness of the bristles within a very precise range, and if necessary, by increasing their diameter, it is possible to obtain a nail varnish brush which has a product loading capacity superior to that of the conventional brushes, and hence a greater inherent capacity. It is also possible to expand the viscosity range of the varnish over that of conventionally used varnishes, thus opening the way for new and original nail varnish compositions. Also it is possible to obtain a varnish surface on the nail that is more homogeneous and thicker, without the formation of striae.

It has, surprisingly, been found that the appearance of the make-up thus obtained was shinier, and that the mechanical strength of the applied layer, after drying, as well as the solidity of the adhesion of the varnish on the nail were increased. It has, moreover, been found that the new brush in accordance with the invention is capable of drawing the varnish over the surface to be treated, instead of pushing it.

SUMMARY OF THE INVENTION

In accordance with a first aspect of the invention, there is provided a brush for applying a make-up product, comprising a tuft of substantially parallel bristles first ends of which are fixed to a free end of a stem, wherein all or a proportion of said bristles of said tuft are made of at least one elastomeric thermoplastic or vulcanized material.

According to a second embodiment of the invention, there is provided a method of applying a nail varnish using a brush comprising a tuft of substantially parallel bristles first ends of which are fixed to a free end of a stem, wherein all or a proportion of said bristles of said tuft are made of at least one elastomeric thermoplastic or vulcanized material.

According to a third embodiment of the invention, is provided a kit for applying nail varnish comprising a container, a stopper with an applicator element and a nail varnish, wherein the applicator element is a brush comprising a tuft of substantially parallel bristles first ends of which are fixed to a free end of a stem, wherein all or a proportion of said bristles of said tuft are made of at least one elastomeric thermoplastic or vulcanized material.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
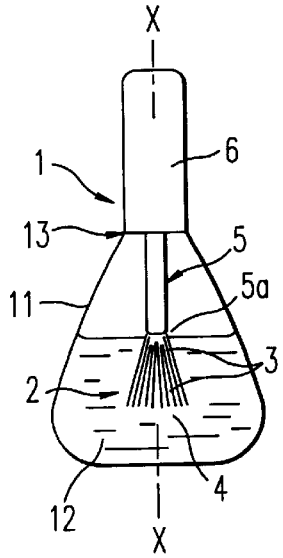
FIG. 1 is a simplified view, in elevation, of a nail varnish unit in accordance with the invention.

The brush of the invention may have bristles made of an elastomeric thermoplastic material selected from the group consisting of elastomers of polyethylene, polyurethane, polyester, or from the group of polyester block amides, polyvinyls, terpolymers of ethylene, of propylene and of a diene (EPDM); or sequenced polymers of styrene-butadiene (SEBS-SIS). Advantageously the thermoplastic elastomer has a Shore A hardness in the range of 40 to 80.

As examples of suitable vulcanized elastomers they may be selected from the group consisting of silicone rubbers; rubbers with nitrile properties; terpolymers of ethylene, propylene and a diene (EPDM); natural rubbers; polynorbordenes; and butyl rubbers.

Advantageously, the vulcanized elastomer has a Shore A hardness in the range of 15 to 90.

The bristles may also be made from a combination of at least one thermoplastic non-elastomeric polymer with at least one thermoplastic elastomer or vulcanized elastomer. In particular the combination may be constituted by a mixture of (i) a non-elastomeric thermoplastic polymer selected from the group consisting of polyesters, polyamides, polypropylenes, polyvinyl chlorides, viscose, and rayon and (ii) a thermoplastic elastomer selected from the group consisting of polyether blockamides; polyvinyls; terpolymers of ethylene, propylene and a diene (EPDM); and sequenced polymers of styrene-ethylene-butadiene (SEBS-SIS).

Advantageously, the combination is constituted by a mixture of 90% to 40% by weight preferably from 80% to 90% of a non-elastomeric thermoplastic polymer and of 10% to 60% by weight preferably from 20% to 50% of a thermoplastic elastomer selected from those mentioned above. Preferably the combination has a hardness comprised in the range of 60 Shore A to 40 Shore D.

In accordance with the invention, the tuft of bristles of the brush may contain 2% to 100%, preferably 5 to 75%, more preferably 10 to 70% of bristles made of at least one elastomeric thermoplastic or vulcanized material, the other bristles of the tuft conforming to the state of the art. As bristles conforming to the state of the art, there may be mentioned those made of a non-elastomeric synthetic or natural material, it being possible for the material constituting the bristles to be chosen, for example, from polyamides, polyesters, polyether-blockamides, polyethylene, polytetrafluoroethylene, vinylidene polyfluoride, polyacetates; and natural silks, preferably of animal origin.

The bristles made of at least one thermoplastic elastomeric or vulcanized material preferably have a cross-section inscribed within a circle with a diameter $\phi$ ranging, for example from 60 $\mu$m (0.06 mm) to 300 $\mu$m (0.30 mm). The other bristles of the tuft preferably have a cross-section inscribed within a circle with a diameter ranging, for example, from 30 $\mu$m (0.03 mm) to 200 $\mu$m (0.20 mm).

Advantageously, the tuft of the bristles of the brush has a length ranging from 10 mm to 25 mm, and preferably a length ranging from 13 mm to 20 mm.

According to an advantageous aspect of the invention, the bristles have a first end obtained by bending a bundle of fibers into a U, the base of the U being held in position by a staple driven into a cutout cut in the free end of the brush stem. Advantageously, this cutout is a cylinder of revolution. It may also be formed in an oval, an elongate, or a cruciform shape, or in the shape of a half-round tile. This cutout may flare towards the free end of the stem. The fixing of the tuft of bristles in this cutout may also be effected by gluing, or by any other means usually used for manufacturing bristles, by a ferrule, or else for example by duplex injection or compound injection.

The number of bristles constituting the tuft is advantageously comprised in the range of 5 to 600 and preferably 100 to 500.

If it is intended to make a brush for the application of a composition with a low viscosity, the brush may be constituted by approximately 500 bristles with a diameter of about 100 $\mu$m (0.10 mm). In the case where the brush is intended for the application of a nail varnish with a low viscosity, the latter has a value of at most equal to 0.6 Pa.s. If, on the other hand, one wishes to apply a formula with a high viscosity, the number of bristles will advantageously be chosen to be approximately 120 and having a diameter of about 240 $\mu$m (0.24 mm).

The nail varnish to be applied may be any nail varnish conventionally know in the art, as well as nail varnishes with viscosities greater and less than that of conventional nail varnishes.

The material constituting the bristles may advantageously contain an agent modifying their surface state and/or their sliding characteristics and/or reducing their absorptivity of water, or of a solvent contained in the make-up product and in particular in the varnish, or an anti-static agent.

Advantageously, the agent improving the sliding characteristic of the bristle and reducing its absorptivity of water and of the solvent, is incorporated in the material of the bristles in a proportion ranging from 0.2% to 15% by weight, preferably 0.5 to 10% by weight.

Sliding agents are conventional to the art and are preferably selected from the group consisting of polytetrafluoroethylene, boron nitride, molybdenum disulphide, graphite, the silicones, fullerene, talc and a mixture thereof.

Advantageously, at least a proportion of the bristles may have slight undulations over its length. The bristles may have cross-sections whose shape is selected from the group consisting of circular, annular, polygonal, cruciform, rectangular, multilobal, U-shaped, C-shaped, V shaped, and shaped to have at least one capillary groove.

The free end of the bristles constituting the brush may be arranged in the form of a pin head, obtained in particular by a heat treatment, for example by singeing. The free end of the bristles may also be frayed, this fraying being obtained, for example by grinding or teasing.

The cross-section of the brush may have various shapes; the tuft may in particular have a circular cross-section, a half round tile cross-section, an oval, or a cruciform cross-section. Moreover, the bristles may have different lengths, in particular the free end of the brush may be flat or rounded.

The brush having the characteristics described above is particularly suitable for the application of a nail varnish or a liquid make-up. Thus the present invention also provides a unit for applying nail varnish constituted by a container generally made of glass and provided with a neck, and a stopper joined to an applicator element submerged in the storage position in a nail varnish contained in this container, wherein the applicator element is a brush such as in the first aspect defined above.

Apart from the arrangements set out above, the invention consists of a certain number of other arrangements which will be discussed in greater detail below with regard to examples of the embodiment described with reference to the attached drawings, which are in no way restrictive.

Referring to FIG. 1, there may be seen a nail varnish unit comprising a brush (1) for the application of varnish (12), which comprises a tuft (2) of bristles (3) fixed to one end (5*a*) of a stem (5) and oriented substantially along the axial direction of the stem. A cylindrical sleeve (6) is joined to the other end of the stem (5), that is on the opposite end to the tuft (2), the stem being engaged in the sleeve (6). This cylindrical sleeve (6) serves as the element for manipulating the brush. It also serves as a stopper intended, for example, to be screwed on the neck (13) of a bottle (11) of varnish (12). The tuft (2) is obtained from a bundle of bristles (3) folded in two substantially parallel, approximately halfway along.

Figure 2:
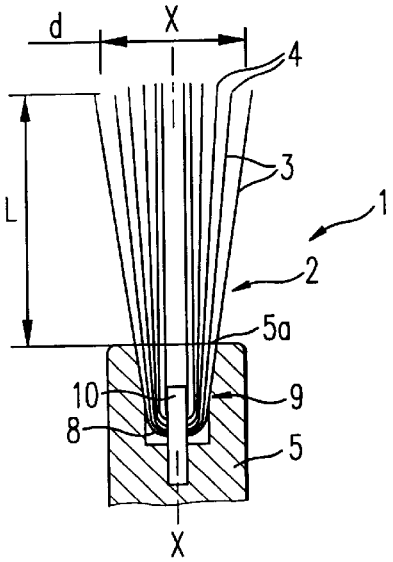
FIG. 2 is a schematic view, on an enlarged scale in a partial axial section, of the end of the stem in accordance with the invention illustrating the tuft of bristles.

The tuft (2) is fixed to the free end (5*a*) of the stem (5) by tight engagement of the folded portion (8) of the tuft of bristles, as shown in FIG. 2, in a cutout (9) formed by a blind hole which opens at the free end of the stem (5). Generally, the tuft (2) is formed by placing the median zone of the bundle of bristles at the inlet of the cutout (9) of the stem (5). A staple (10) is then engaged round the zone situated substantially halfway along the bundle of bristles and is driven into the cutout (9), causing the folding of the bristles (3) which come to bear against the edge of the cutout (9). During this operation, the staple (10) is bent back so as to hold the bristles tightly, and is force-fitted into the stem (5).

Figure 15:
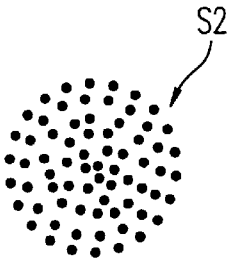

The staple (10) is made from a metallic wire, folded into a U, whose cross-section can be circular, rectangular, flat or square. The diameter, or the large side, of the wire section is advantageously from 0.2 to 1.5 mm. As may be seen in FIG. 2, the end zone of the cutout (9) may be a cylinder of revolution with axis X—X, with an end zone having a flared frustoconical shape of revolution. The tuft (2) of the brush (1) implanted in such a cutout has the shape of a cone frustum with a substantially circular base (see FIG. 15).

Figure 3:
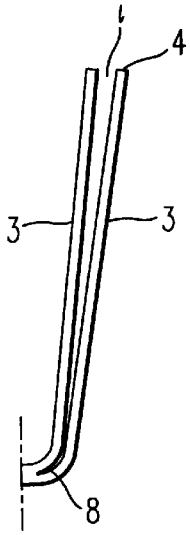
FIG. 3 is a schematic view, on an enlarged scale, of the bristles of the brush of the invention after they have been implanted in the stem.

As shown in FIG. 3, the conditions for the implantation of the bristles (3) in the cut-out (9), are determinative for the creation of the interstices (i). In fact, these interstices (i) are responsible for the capacity of the product uptake and hence the inherent capacity of the brush. Thus capillary reserves are created for the product to be applied; the quantity of the product taken up by the brush can be adjusted according to the viscosity of the product.

Figure 4:
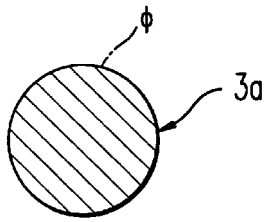
FIGS. 4 to 9 are diagrams of various possible cross-sections for the bristles of the brush in accordance with the invention, inscribed in a circle with a constant diameter ($\phi$).
Figure 5:
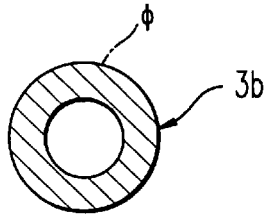
Figure 6:
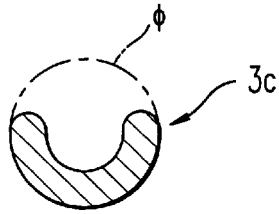
Figure 7:
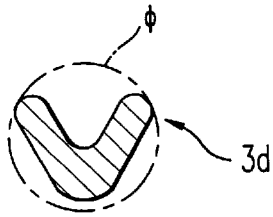
Figure 8:
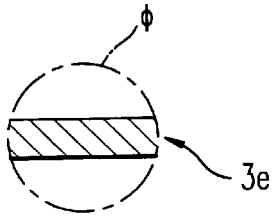
Figure 9:
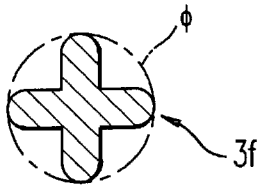

As may be seen in FIGS. 4 to 9, the cross-sections of the bristles (3) are inscribed in a circle (ϕ) with a diameter ranging from 60 μm to 300 μm (0.06 to 0.30 mm); preferably the cross-section is chosen in the range of 110–250 μm (0.11 to 0.25 mm). Moreover, the cross-sections of the bristles (3) may have various shapes; they may be circular (3*a*), as illustrated in FIG. 4; annular (3*b*), as illustrated in FIG. 5; or C-shaped (3*c*) as shown in FIG. 6; V-shape (3*d*) as shown in FIG. 7; they may have a flat rectangular shape (3*a*) as shown in FIG. 8; or they may be polygonal, in particular square or cruciform (3*f*), as shown in FIG. 9.

Figure 10:
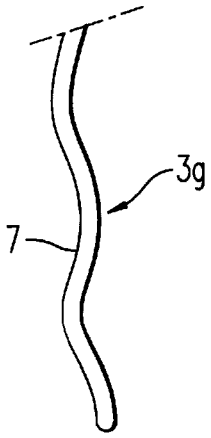
FIG. 10 shows a bristle of the brush of the invention having a slight undulation.

As illustrated in FIG. 10, the bristles (3*g*) may not be straight, and they may have slight undulations (7) over at least a part of their length.

Figure 11:
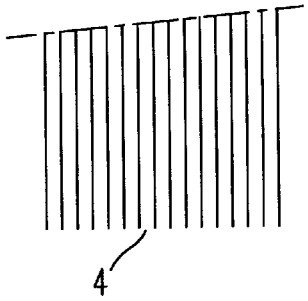
FIGS. 11 and 12 show, in elevation, two possible forms for the free end of the brush of the invention on an enlarged scale.
Figure 12:
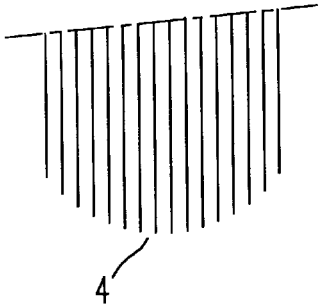
Figure 13:
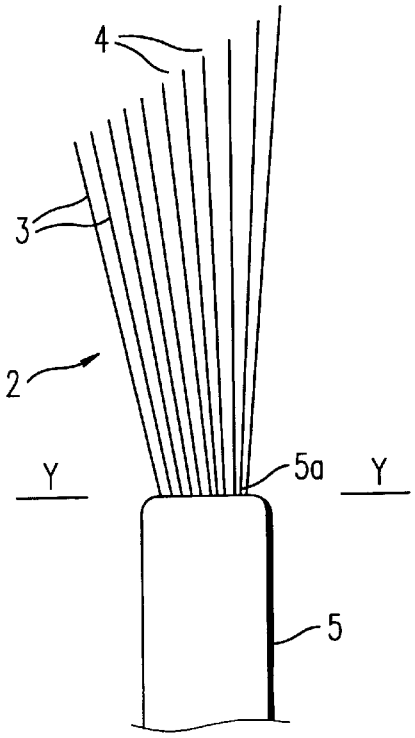
FIG. 13 is a side view of another possible form for the free end of the brush of the invention.

Moreover, the tuft (2) of the bristles of the brush (1) may have different shapes in cross-section. According to FIG. 11, the end of the tuft (2) is flat and the free ends (4) of the bristles are substantially equal. According to FIG. 12, the set of the ends (4) of the bristles (3) has a rounded configuration obtained, for example, by clipping. According to the embodiment in accordance with FIG. 13, the ends (4) of the bristles (3) are clipped so that the bristles have different lengths and their ends form an oblique line relative to the direction Y perpendicular to the axis X—X.

Figure 14:
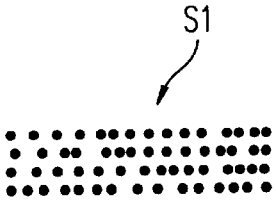
FIGS. 14 to 16 illustrate possible cross-sections for the cut-out for the fixed end of the bristles of the brush in accordance with the invention.
Figure 16:
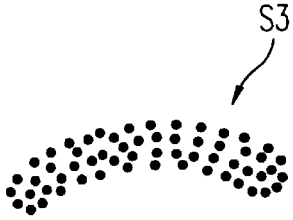

In all these cases, the brush may, moreover, have: a cross-section S1 of a substantially rectangular shape, as shown in FIG. 14; a circular cross-section S2, as shown in FIG. 15, or yet again a cross-section S3 of a round tile, as shown in FIG. 16.

It shall be duly understood that the brush may be constituted by different types and shapes of the bristles having the characteristics described above.

When a cylindrical brush in accordance with the invention is made, the diameter (d) (FIG. 2) of the tuft (2) of the bristles (3) is generally within the range of 4 to 6 mm.

The use of bristles made of a flexible material, such as described above, obtains a brush which, during the application of the varnish, spreads out the free ends (4) of the bristles in a fan-shape, making it possible to paint a nail in only two applications. In other words, during the application the d/L ratio (where L is the maximum length of the bristles) is increased by using bristles made of a flexible material in accordance with the invention. The deposited varnish layer is homogeneous, thick and, after drying, has improved adhesive properties as compared with those obtained with the known brushes. Moreover, the surface of the layer has a shiny appearance, and its application is effected in a precise manner.

Having generally described this invention, a further understanding can be obtained by reference to certain specific examples which are provided herein for purposes of illustration only and are not intended to be limiting unless otherwise specified.

Precise examples of embodiments of brushes in accordance with the invention are given below:

EXAMPLE 1

A brush is made comprising a tuft of bristles with an apparent length L of 22 mm with 100% flexible bristles being made of a polyether block amide with a trilobal cross-section and having a diameter of 290 μm (0.29 mm). The number of bristles is approximately 250. This brush makes it possible to obtain on the nail a very heavy single layer of excellent brilliance.

EXAMPLE 2

A brush is made having a tuft of bristles of an apparent length (L) of 20 mm, 100% of the bristles have a diameter of 170 μm (0.17 mm) with a trefoil shape made of a polyamide 11/polyether blockamide (70/30) combination. The number of bristles is approximately 320. This brush is suitable for applying a single layer of fluid formulas without the formation of striae, while retaining a heavy thickness of the applied varnish.

EXAMPLE 3

A brush is made having a tuft of bristles of an apparent length of 17 mm. 30% of the bristles have a diameter of 170 μm (0.17 mm) made of a combination of polyamide 11/polyether block amides (70/30) enriched with molybdenum bisulphide (5%) with a V-shaped cross-section, and the other 70% of the bristles have a diameter of 80 μm (0.08 mm) with a circular cross-section made of a polyester elastomer (Hytrel$^R$). The number of bristles is approximately 420. This brush has the properties of creating a very shiny smooth and thick layer.

EXAMPLE 4

A brush is made having a tuft of bristles of an apparent length (L) of 17 mm. 30% of the bristles have a diameter of 170 μm (0.17 mm) made of a thermoplastic elastomer of polyurethane, with a horseshoe-shaped cross-section, and the remaining 70% of the bristles have a diameter of 40 μm (0.04 mm) with a circular cross-section made of polyamide 6–12 (nylon TYNEX). The number of bristles is approximately 350. This brush has the same characteristics as those mentioned in the preceding examples.

EXAMPLE 5

A brush is made having a tuft of bristles of an apparent length (L) of 15 mm. 10% of the bristles have a diameter of 250 μm (0.25 mm) of a thermoplastic elastomer of polyether block amide (PEBAX from the ATOCHEM Company) with a circular cross-section. The other 90% are wavy bristles with a diameter of 60 μm (0.06 mm) with a circular cross-section made of polyamide 6–12 (nylon TYNEX). The number of bristles is approximately 400. This brush has the same characteristics as those mentioned in the preceding examples.

EXAMPLE 6

A brush is made having a tuft of bristles of an apparent length (L) of 13 mm. 70% of the bristles have a diameter of 130 μm (0.13 mm) made of a thermoplastic elastomer of a block amide polyether (PEBAX from the ATOCHEM Company) with a cruciform cross-section. The other 30% of the bristles have a diameter of 60 μm (0.06 mm) with a circular cross-section made of polyamide 6–12 (nylon TYNEX)). The number of bristles is approximately 320. This brush has the same characteristics as those mentioned in the preceding examples.

Thanks to the bristles made of a more flexible material than that of the prior art, a brush in accordance with the invention follows the convex shape of the nail better and, because of its large reservoir capacity and its spreading capacity, makes it possible to paint a nail in less than two applications. The deposited layer is shinier, more homogeneous and thicker, showing a distinct increase in coverage as compared with those obtained with the conventional brushes. The test results have proved to be surprising. In particular, an extreme ease of use, a high accuracy in the coverage and, above all, a greater mechanical strength and a better adhesion of the make-up on the nail will be found with a brush in accordance with the invention.

Obviously, numerous modifications and variations of the present invention are possible in light of the above teachings. It is therefore to be understood that within the scope of the appended claims, the invention may be practiced otherwise than as specifically described herein.

This application is based on French Patent Application 94-02945, filed in the French Patent Office on Mar. 14, 1994, the entire contents of which are hereby incorporated by reference.

What is claimed as new and desired to be secured by Letters Patent of the United States is:

1. A brush for the application of a make-up product, comprising:

a tuft of substantially parallel bristles, a first end of said bristles being fixed to a free end of a stem having an axial direction, wherein said tuft of substantially parallel bristles are oriented substantially along the axial direction of the stem, and wherein at least a proportion, of the bristles are comprised of a combination of at least one non-elastomeric thermoplastic polymer with at least one material selected from the group consisting of an elastomeric thermoplastic, a vulcanized material and a mixture thereof.

2. The brush of claim 1, wherein said elastomeric thermoplastic is selected from the group consisting of elastomeric polyethylene, elastomeric polyurethane, elastomeric polyester and a mixture thereof.

3. The brush of claims 1, wherein said elastomeric thermoplastic material has a Shore A hardness in the range of 40 to 80.

4. The brush of claim 1, wherein said material is a vulcanized material selected from the group consisting of a silicone rubber, rubbers with a nitrile function, EPDMs (terpolymers of ethylene, propylene and a diene), natural rubbers, polynorbordenes, and butyl rubbers.

5. The brush of claim 1, wherein said vulcanized material has a Shore A hardness in the range of 15 to 90.

6. A brush for the application of a make-up product, comprising:

a tuft of substantially parallel bristles, a first end of said bristles being fixed to a free end of a stem having an axial direction, wherein said tuft of substantially parallel bristles are oriented substantially along the axial direction of the stem, and wherein at least a proportion, of said bristles are comprised of a combination of at least one thermoplastic non-elastomeric polymer selected from the group consisting of polyesters, polyamides, polypropylenes, polyvinyl chlorides, viscose, rayon, and at least one thermoplastic elastomer.

7. The brush of claim 6, wherein at least a proportion, of said bristles are comprised of a combination of 90% to 40% by weight of a non-elastomeric thermoplastic polymer and of 10% to 60% of a thermoplastic elastomer.

8. The brush of claim 6, wherein at least a proportion, of said bristles are comprised of a combination having a hardness in the range of 60 Shore A to 40 Shore D.

9. The brush of claim 1, wherein said bristles are comprised of at least one elastomeric material have a cross-section inscribed within a circle of diameter (ϕ) ranging from 60 to 300 μm.

10. The brush of claim 1, wherein said tuft further comprises bristles comprised of a non-elastomeric material.

11. The brush of claim 10, wherein said bristles comprised of a non-elastomeric material have a cross-section inscribed within a circle with a diameter ranging from 30 to 200 μm.

12. The brush of claim 11, wherein said tuft of said bristles has a length ranging from 10 to 25 millimeters.

13. The brush of claim 6, wherein said first end of said bristles is held in position by a staple driven into a cut-out cut in said free end of said stem.

14. The brush of claim 1, wherein a number of said bristles constituting said tuft is in the range of 5 to 600.

15. The brush of claim 1, wherein said bristles further comprise at least one of an agent modifying their surface state, an agent modifying their sliding characteristics, an agent reducing their absorptivity of water, an agent reducing their absorptivity of a solvent and a mixture thereof.

16. The brush of claim 15, wherein said agent is present in a proportion ranging from 0.2 to 15% by weight.

17. The brush of claim 16, wherein said agent modifies their sliding characteristics and is selected from the group consisting of polytetrafluoroethylene, boron nitride, molybdenum disulfide, graphite, the silicones, fullerene, talc and a mixture thereof.

18. The brush of claim 1, wherein at least a proportion of said bristles has slight undulations.

19. The brush of claim 1, wherein said bristles have a cross-sectioned shape selected from the group consisting of circular, annular, polygonal, cruciform, rectangular, multilobal, U-shaped, C-shaped, or V-shaped, and shapes including at least one capillary groove.

20. The brush of claim 19, wherein said cross-sectioned shape of said tuft has a shape selected from circular, oval, cruciform, and the shape of a half-round tile.

21. The brush of claim 1, wherein said bristles have a second free end treated by a method selected from the group consisting of singeing, grinding, and teasing.

22. A method for applying nail varnish, comprising applying nail varnish with a brush for the application of a make-up product, comprising:

a tuft of substantially parallel bristles, a first end of said bristles being fixed to a free end of a stem having an axial direction, wherein said tuft of substantially parallel bristles are oriented substantially along the axial direction of the stem, and wherein at least a proportion, of said bristles of said tuft are comprised of a combination of at least one non-elastomeric thermoplastic polymer with at least one material selected from the group consisting of an elastomeric thermoplastic, a vulcanized material and a mixture thereof.

23. A unit for applying a nail varnish comprising:

1) a container provided with a neck;

2) a stopper joined to an applicator element submerged, in a storage position; and 3) a nail varnish contained in said container, wherein said applicator element is a brush for the application of a make-up product, comprising:

a tuft of substantially parallel bristles, a first end of said bristles being fixed to a free end of a stem having an axial direction, wherein said tuft of substantially parallel bristles are oriented substantially along the axial direction of the stem, and wherein at least a proportion, of said bristles of said tuft are comprised of a combination of at least one non-elastomeric thermoplastic polymer with at least one material selected from the group consisting of an elastomeric thermoplastic, a vulcanized material and a mixture thereof.

24. The brush of claim 1, wherein said elastomeric thermoplastic is selected from the group consisting of polyether block amides, polyvinyls, EPDMs (terpolymer of ethylene, propylene and a diene), and SEBS-SISs (sequenced polymers of styrene-ethylene-butadiene).

25. A brush for the application of a make-up product, comprising:

a tuft of substantially parallel bristles, a first end of said bristles being fixed to a free end of a stem having an axial direction, wherein said tuft of substantially parallel bristles are oriented substantially along the axial direction of the stem, and wherein at least a proportion, of said bristles of said tuft are comprised of a combination of at least one non-elastomeric thermoplastic oolymer with a vulcanized rubber material.

* * * * *

UNITED STATES PATENT AND TRADEMARK OFFICE

CERTIFICATE OF CORRECTION

PATENT NO. : 6,176,631 B1 
DATED : January 23, 2001
INVENTOR(S) : Jean-Louis Gueret It is certified that error appears in the above-identified patent and that said Letters Patent is hereby corrected as shown below:

Column 8,
Line 13, "claims 1," should read -- claim 1, --;

Column 10,
Line 32, "oolymer" should read -- polymer --.

Signed and Sealed this

Eleventh Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,176,631 B1 
DATED : January 23, 2001
INVENTOR(S) : Jean-Louis Gueret It is certified that error appears in the above-identified patent and that said Letters Patent is hereby corrected as shown below:

Column 8,
Line 52, "claim 11," should read -- claim 1, --;
Line 54, "Claim 6," should read -- claim 1, --.

Signed and Sealed this

Sixth Day of July, 2004

JON W. DUDAS
*Acting Director of the United States Patent and Trademark Office*